US006871990B2

(12) United States Patent
Imazeki et al.

(10) Patent No.: US 6,871,990 B2
(45) Date of Patent: Mar. 29, 2005

(54) VEHICLE LAMP WITH VISOR

(75) Inventors: Norifumi Imazeki, Kanagawa-ken (JP); Takashi Nakanishi, Tokyo (JP); Takeaki Okamura, Kanagawa-ken (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 10/439,304

(22) Filed: May 16, 2003

(65) Prior Publication Data

US 2004/0022066 A1 Feb. 5, 2004

(30) Foreign Application Priority Data

May 17, 2002 (JP) ..... 2002-143274

(51) Int. Cl.[7] ..... F21V 7/04

(52) U.S. Cl. ..... 362/517; 362/297; 362/330; 362/359

(58) Field of Search ..... 362/290, 297, 362/298, 301, 517, 518, 342, 339, 292, 303, 322, 323, 325, 507, 330, 359, 354

(56) References Cited

U.S. PATENT DOCUMENTS 1,357,034 A * 10/1920 D Humy ..... 362/290
1,457,630 A * 6/1923 Johnson ..... 362/290
1,598,106 A * 8/1926 Schoonmaker ..... 362/283
2,228,329 A * 1/1941 Reynolds ..... 362/514
3,586,851 A * 6/1971 Rudolph ..... 362/293
4,480,291 A * 10/1984 Dranginis ..... 362/517
4,799,131 A * 1/1989 Aho et al. ..... 362/518
5,115,384 A * 5/1992 Loth et al. ..... 362/301
6,332,701 B1 12/2001 Yamada et al.

FOREIGN PATENT DOCUMENTS

JP 5-94705 4/1993
JP 7-38282 4/1995

* cited by examiner

*Primary Examiner*—Sandra O'Shea
*Assistant Examiner*—Hargobind S. Sawhney
(74) *Attorney, Agent, or Firm*—Morgan, Lewis & Bockius LLP

(57) ABSTRACT

A vehicle lamp can include a primary light source and a visor for preventing the lamp from falling into a state of false illumination due to incident light from light sources other than the primary light source. The lamp can irradiate light toward a predetermined direction. The visor can be provided at a position close to either the light source or a false light source formed by light from the light source. The visor can include a plurality of grooves extending horizontally on one surface thereof, and the grooves can have a V-shaped cross section. An angle made by two sides forming the V-shaped cross section is preferably an acute angle.

31 Claims, 4 Drawing Sheets

VEHICLE LAMP WITH VISOR

This invention claims the benefit of Japanese Patent Application No.2002-143274 filed on May 17, 2002, the disclosure of which is hereby incorporated by reference.

BACKGROUND OF THE INVENTION

1. Field of the Invention

The present invention relates to vehicle lamps such as tail lamps, turn signals and stop lamps (brake lights) mounted on a vehicle for signaling purposes. More particularly, it relates to a vehicle lamp provided with a visor so that it does not give a false impression as if it were turned on when illuminated by sunlight during the daytime.

2. Description of the Related Art

FIG. 1 shows the configuration of one such conventional vehicle lamp 90, which employs an LED lamp as its light source. The lamp 90 includes LED lamps 92, a lamp holder 93, and an outer lens 91. A recent trend in vehicle lamp design is to make the lamp with a feeling of high transparency; accordingly, the outer lens 91 of this lamp 90 is a transparent type having no cut lines or the like provided on the surface thereof.

Since the inside of the lamp 90 constructed as described above is visible from the outside through the outer lens 91, one face of the lamp holder 93 to which the LED lamps 92 are attached is coated entirely with aluminum by vacuum deposition or the like for providing a shining effect on the side of the outer lens 91. The front face of the holder 93 thus functions as a reflection mirror, thereby giving the lamp a good outer appearance.

However, because of this shining effect of the lamp holder 93, it reflects sunlight beamed into the lamp 90 during the daytime. Depending on the incident angle, the sunlight may be reflected by the lamp holder 93 and pass through the outer lens 91. This reflected sunlight may give the driver of another vehicle the false impression as if the lamp 90 were illuminated.

SUMMARY OF THE INVENTION

The present invention has been devised to solve the above and other problems. The invention can include a vehicle lamp with a visor which is unlikely to give a false impression of emitting light when illuminated by light from the outside of the lamp.

A vehicle lamp according to the present invention can include a light source and a visor for preventing the vehicle lamp from falling into a state of false illumination due to incident light from other light sources, and can be capable of irradiating light from the light source toward a predetermined direction. The visor can be provided at a position close to either the light source or a pseudo-light-source formed by light from the light source, and the visor can have a plurality of grooves extending horizontally on one surface thereof. The grooves can have a V-shaped cross section, and an angle made by two sides forming this V-shaped cross section is preferably an acute angle.

The vehicle lamp of the present invention can include a visor formed by a combination of V-shaped grooves located near the light source or pseudo-light-source. The visor can direct reflection light produced by external light toward directions that are outside the range determined by the light distribution characteristics of the lamp when the lamp is turned on. Thereby a false impression as if the lamp were illuminated can be prevented, and reliable signal transmission to other vehicles and pedestrians is ensured.

In the above vehicle lamp, the two sides forming the V-shaped cross section of the grooves can be oriented upwards from their intersecting points/axes at the bottoms of the grooves. Thereby, prevention of false illumination is ensured.

In the above vehicle lamp, preferably, the surface of the visor may have undergone a shining treatment.

As an option, a light source mounting portion may be provided at an intersecting point of the two sides forming the V-shaped cross section for mounting the light source.

Preferably, the light source may be arranged in front of and below (or at a lower portion of) the visor, and the upper one of the sides forming the V-shaped cross section of the grooves may be inclined at an angle determined so that parallel light from the light source is reflected by the upper one of the sides toward an illuminating direction of the lamp, whereby reflection light from the upper one of the sides is used as a false light source. Alternatively, the light source may be arranged in front of and above (or at an upper portion of) the visor, and a lower one of the sides forming the V-shaped cross section of the grooves may be inclined at an angle determined so that parallel light from the light source is reflected by the lower one of the sides toward an illuminating direction of the lamp, whereby reflection light from the lower one of the sides is used as a false light source.

The vehicle lamp may preferably include a reflection surface for reflecting light from the light source in front of and below (or at a lower portion of) the visor and for irradiating the light toward the upper one of the sides of the visor. Alternatively, the vehicle lamp may include a reflection surface for reflecting light from the light source in front of and above (or at an upper portion of) the visor and for irradiating the light toward the lower one of the sides of the visor.

Preferably, the visor may be divided into a plurality of sections each formed by V-shaped grooves, in which the angle made by the two sides of the grooves oriented upwards relative to a horizontal from their intersecting points/axes is different from one section to the other. Alternatively, the visor may be divided into a plurality of sections each formed by V-shaped grooves, in which the angle made by the two sides of the grooves oriented downwards relative to a horizontal from their intersecting points/axes is different from one section to the other.

Furthermore, the vehicle lamp may preferably include an outer lens.

According to another aspect of the invention, a vehicle lamp capable of irradiating light toward a predetermined direction can include a light source and a visor for preventing the lamp from falling into a state of false illumination due to incident light from an outside light source other than said light source, said visor provided at a position adjacent said light source, said visor having a plurality of grooves on a surface thereof, said grooves each having a longitudinal axis extending horizontally and having a V-shaped cross section as viewed along the longitudinal axis, an angle made by two sides forming said V-shaped cross section being an acute angle.

According to another aspect of the invention, the two sides forming the V-shaped cross section intersect at an intersecting axis located at a bottom of each of the grooves, said two sides forming the V-shaped cross section are oriented upwards relative to a horizontal plane that contains the intersecting axis located at the bottom of each of the grooves.

According to another aspect of the invention, a light source mounting portion is provided at a meeting location between said two sides forming the V-shaped cross section for mounting said light source.

According to another aspect of the invention, the light source can include a LED light source, a halogen light source, a discharge light source, an incandescent light source or a false light source formed by light emitted from a primary light located at a position away from the light source.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
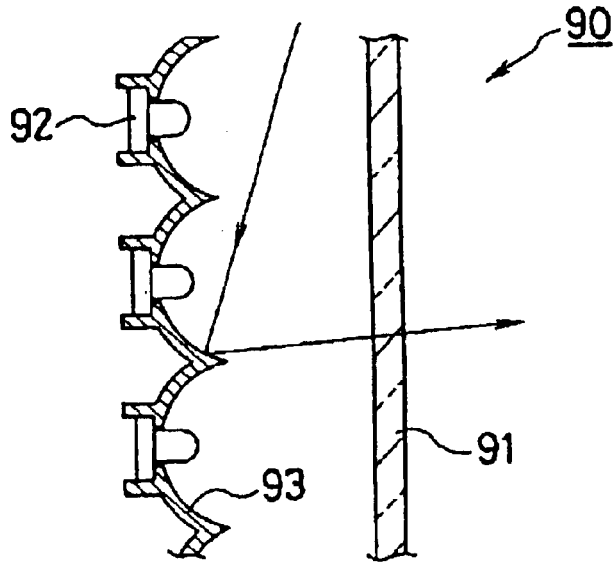
Fig. 1 Related Art
FIG. 1 is a cross-sectional view of a related art vehicle lamp.
Figure 2:
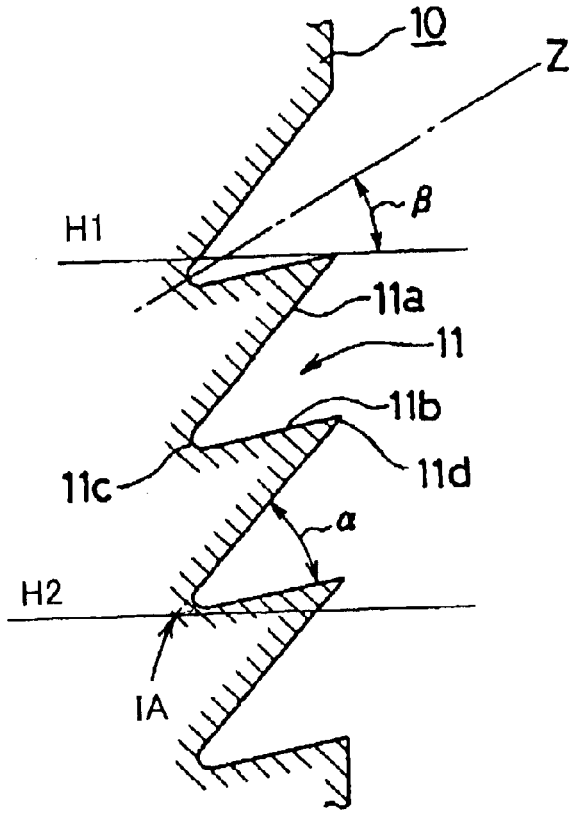
FIG. 2 is a cross-sectional view illustrating a visor portion of a vehicle lamp according to the invention.

Preferred embodiments of the invention will be hereinafter described in detail with reference to the accompanying drawings. Before giving a general description of a vehicle lamp with a visor according to the present invention, a detailed description of a visor 10 will be provided. FIG. 2 is a cross-sectional view illustrating the configuration of a visor 10. The visor 10 can include, and can consist of, a plurality of V-shaped grooves 11 extending in a substantially horizontal direction. The upper sides 11*a* and lower sides 11*b* of the V-shaped grooves 11 preferably form the letter "V" in cross section.

When the vehicle lamp 1 is mounted to a vehicle, the intersections of the upper and lower sides 11*a*, 11*b* of the grooves 11 or the tops 11*d* of the ridges between the grooves can be substantially horizontal when viewed from the front. The grooves can be formed so that the angle $\alpha$ made by the upper side 11*a* and lower side 11*b* in the V-shaped cross section is acute. Preferably, the angle $\alpha$ should be set 60° or smaller. If the angle $\alpha$ is larger than 60°, the effects that the visor provides, which will be described later, may be lowered. The bottoms 11*c* of the grooves can be formed by intersections between the upper sides 11*a* and lower sides 11*b*. The tops 11*d* and bottoms 11*c* of the grooves are preferably as sharp as possible from an optical point of view. In an actual embodiment of the invention, however, they may be slightly rounded as illustrated in the drawing with an appropriate radius, taking into consideration the durability of tools, feasibility of fabricating molds for forming these V-shaped grooves 11, cost of design, cosmetics, and other factors.

In the embodiment of the invention shown in FIG. 2, the upper side 11*a* and lower side 11*b* can extend upwardly from a horizontal plane H2 that contains intersection axis IA. The intersection axis IA can be formed by the intersection of an imaginary plane extending from upper side 11*a* with an imaginary plane extending from lower side 11*b*, as shown in FIG. 2.

According to one aspect of the invention, the V-shaped grooves 11 are formed so that the upper sides 11*a* and lower sides 11*b* in cross section are both oriented upwards from the bottoms 11*c* towards the tops 11*d*, i.e., each top 11*d* is positioned higher than an immediately adjacent bottom 11*c*. Some numbers are given below for describing one specific example: In FIG. 2, the angle made by a horizontal plane H1 and the symmetric axis or center line Z of the V-shaped cross section of the grooves is defined as upward angle $\beta$. Provided that the acute angle $\alpha$ between the upper side 11*a* and lower side 11*b* is 40°, the upward angle $\beta$ of the center line Z is more than 20°, for example, 30°.

Therefore, in this example, the upper sides 11*a* are oriented upwards at an angle of 50° and the lower sides 11*b* at an angle of 10° with respect to the horizontal plane. A plurality of V-shaped grooves 11 formed with such angle settings can be provided continuously so that they are directly adjacent each other in an up and down direction. A number of these V-shaped grooves extending approximately parallel to the horizontal direction can collectively form the visor 10. In the embodiment of FIG. 2, the front face of the visor 10 in which the V-shaped grooves 11 are formed can be a mirror surface made of vacuum-deposited aluminum or the like for shining effects.

A light beam simulating sunlight projected to this visor 10 at an elevation angle of from 80° to 20° was reflected several times (2 to 6) inside the V-shaped grooves 11, and most of the incident light was radiated at an upward elevation angle of about 25° or more to the outside of the V-shaped grooves 11. Meanwhile, part of the incident light was radiated at a downward angle of about 17° or more to the outside of the V-shaped grooves 11.

A further examination led to the discovery that when light is incident at an elevation angle in ranges of from 40° to 50° and from 60° to 70°, part of the light is reflected several different times within the V-shaped grooves 11 and could be radiated in an approximately horizontal direction. However, it was ascertained that the amount of light radiated in the horizontal direction was negligible relative to the incident light amount.

Figure 3:
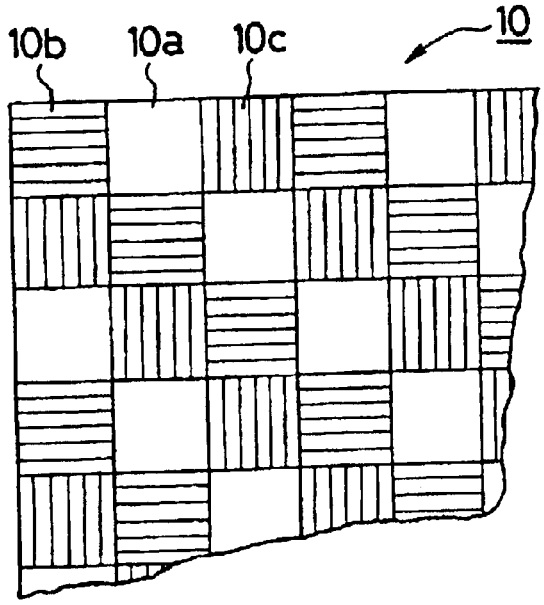
FIG. 3 is a front view of the visor portion of FIG. 2.

FIG. 3 is a front view illustrating a section arrangement pattern applied on the front of a visor 10 that was designed in consideration of the above results of the examination. The V-shaped grooves 11 are formed in a plurality of separate sections arranged in a predetermined pattern such as a check pattern. For example, sections 10*a* includes V-shaped grooves 11 in which the center line Z of the V-shape makes a standard upward angle $\beta$ of, for example, 30°, with a horizontal plane. Sections 10*b* includes V-shaped grooves 11 in which the upward angle $\beta$ is 35°, which is larger than the standard angle by 5°. Sections 10*c* are formed by V-shaped grooves 11 in which the upward angle $\beta$ is 23°, which is smaller than the standard angle by 7°. These sections 10*a*, 10*b*, and 10*c* are arranged in a check pattern to form the visor 10.

The visor 10 is thus constructed with different V-shaped grooves 11 used in combination. By differing the upward angles $\beta$ of the center lines Z of the V-shaped grooves 11, the reflection of sunlight that is incident at a particular elevation angle is dispersed, whereby the vehicle lamp 1 is prevented from falling into a state of false illumination. The upward angle β of the center line Z of V-shaped grooves 11 is obviously not limited to the above-mentioned three examples.

Figure 4:
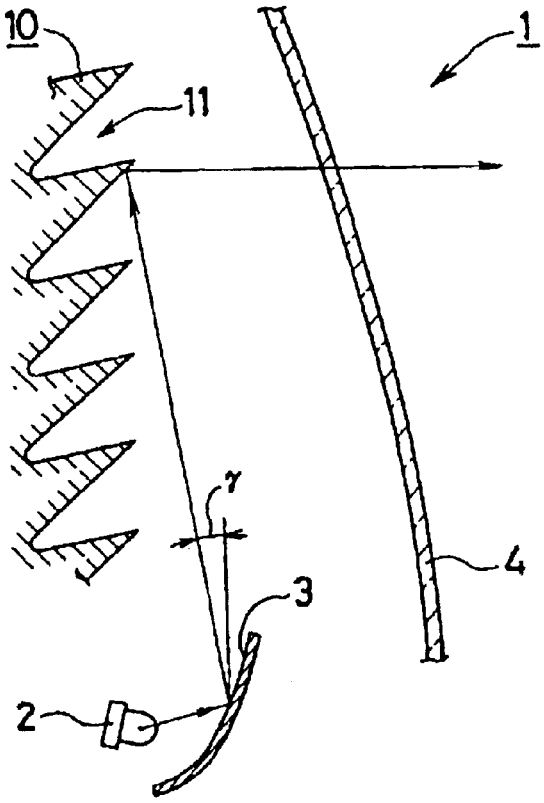
FIG. 4 is a cross sectional view of a vehicle lamp with a visor according to another preferred embodiment of the invention.

FIG. 4 is a cross-sectional view of a vehicle lamp 1 provided with visor 10, according to a preferred embodiment of the present invention. This vehicle lamp 1 can include a light source 2, a reflection mirror 3, the visor 10, and an outer lens 4. Light from the light source 2 is reflected by the reflection mirror 3, and is further reflected by the upper sides 11*a* of the visor 10 toward an illuminating direction, thereby emitting illumination light for a signaling purpose or the like.

The light source 2 which can be an LED lamp or a light bulb is arranged below and in front of the visor 10 in the embodiment of FIG. 4. The reflection mirror 3 can include a parabolic column face having a parabolic vertical cross section and a linear horizontal cross section. FIG. 4 illustrates its vertical cross section; an approximately parallel light beam is reflected on its face and projected toward the visor 10.

The visor 10 used in this lamp can include three types of V-shaped grooves 11 as described in the foregoing: Sections 10*a* can be formed by V-shaped grooves 11 with the center line Z of the standard upward angle of 30°, sections 10*b* can be formed by V-shaped grooves 11 with an upward angle which is larger than the standard angle by 5°, and sections 10*c* can be formed by V-shaped grooves 11 with an upward angle which is smaller than the standard angle by 7°. The V-shaped grooves can be formed with differing upward angles because if the upper sides 11*a* of all the V-shaped grooves are oriented in the same direction, a good balance may not be achieved in the direction of reflected light, i.e., desired light distribution requirements may not be satisfied, especially in the up-down direction. Therefore, the angles of the V-shaped grooves should be differed so that the light distribution properties can be adjusted as required or preferred. For example, sections 10*b* reflect incident light in a direction upward at 10° with respect to the horizontal, while sections 10*c* reflect incident light in a direction downward at 15° with respect to the horizontal.

In the designing of the upper sides 11*a*, the angle γ of the light beam from the reflection mirror 3 to the upper side 11*a* of the visor 10 with respect to a vertical plane is used as a parameter. Light emitted from the light source 2 reaches the upper side 11*a* via the reflection mirror 3, and is reflected by the upper side 11*a* to the outside. Here, only the distal end portion of the upper side 11*a* contributes to reflection of light from the light source 2. The section pattern of the visor 10 predetermines the directions to which the upper sides 11*a* should reflect incident light. This section pattern can be determined in accordance with the standardized requirements for light distribution properties of vehicle lamps, such as rear lamps. The reflecting directions of the upper sides 11*a* can differ from sections 10*a* to sections 10*b* or 10*c*. When designing the upper sides 11*a* of the V-shaped grooves, these predetermined reflecting directions, as well as the positions of the reflection mirror 3 and light source 2, should be taken into consideration so as to satisfy basic requirements for fulfilling expected functionality of the visor 10. The basic requirements are that the angle of the tops 11*d* of the V-shaped grooves is acute and that one of the sides making this acute top angle is positioned below a horizontal line passing through the top 11*d*.

More specifically, with respect to the sections 10*a* formed by standard V-shaped grooves 11, in order that light from the light source 2 is reflected by the visor 10 toward an approximately horizontal direction as shown in FIG. 4, the light is oriented at an angle γ of 10° by the reflection mirror 3 toward the visor 10. In sections 10*b* formed by V-shaped grooves 11 that are oriented further upward, the light from the same reflection mirror 3 is reflected by the visor 10 at an angle upward at 10° from the horizontal. In sections 10*c* formed by V-shaped grooves 11 that are oriented downward, the light is reflected at an angle downward at 15° from the horizontal. Desired light distribution characteristics of the visor 10 can thus be achieved by mixing these reflected light beams. This means that the outer lens 4 need not play a large part in attaining the desired light distribution characteristics. The V-shaped grooves should preferably be formed at a pitch of about 5 to 7 mm.

The visor 10 is thus constructed with several different V-shaped grooves 11 having different upward angles β of the center line Z, so that desired light distribution properties of the vehicle lamp 1 can effectively be achieved. This construction increases the effect of preventing a false impression of illumination mentioned above. The vehicle lamp 1 also utilizes a technique of making a large area appear as shining by the illumination of a large number of "false" or "pseudo-" light sources, i.e., the reflection surfaces formed by the large number of V-shaped grooves 11 are illuminated by a small number of light sources 2. This technique can readily be adopted by using LED lamps, whose output has been much improved in recent years, whereby a cost reduction can be achieved.

Figure 5:
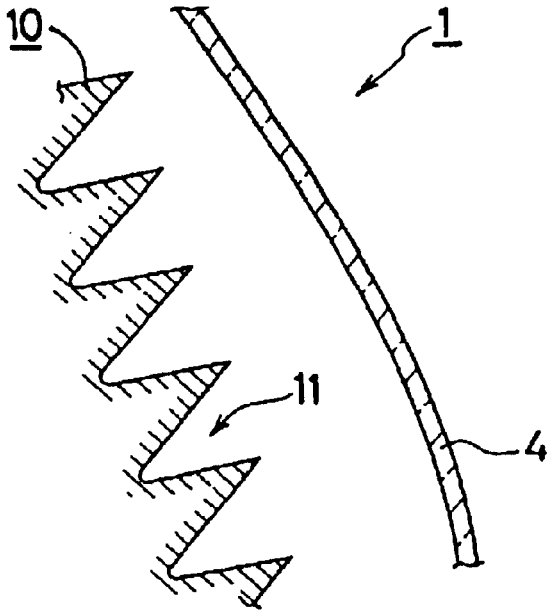
FIG. 5 is a cross sectional view of a vehicle lamp with a visor according to another preferred embodiment of the invention.

The shape of the visor 10 of the above embodiments is easily affected by the vehicle design. FIG. 5 shows another embodiment of a visor 10 formed by combining several different V-shaped grooves 11 as one alternative to allow for flexible design. Each of the V-shaped grooves 11 can be shifted backwards relative to an adjacent groove, so that the visor 10 as a whole is bent backward. This configuration will enable more flexible vehicle design. In this case also, each of the V-shaped grooves 11 is formed according to the predetermined angle settings for the acute angle α and upward angle β of the center line Z so the visor has the effects mentioned above.

All the examples of the grooves given above have upward V-shapes, but this feature is not an absolute requirement; the grooves can be oriented downwards depending on the position of the light source 2. For example, if the light source 2 and reflection mirror 3 are located above the visor 10, light from the reflection mirror 3 is reflected by the lower sides 11*b* toward a predetermined direction. The design of the V-shaped grooves should therefore be oriented generally downwards to achieve necessary light distribution characteristics (see FIG. 6). In this case, the lamp should be designed according to the conditions similarly to the aforementioned conditions where the light source is located below the visor. In this case, an upper side 11*a* constitutes a top 11*d* with the lower side 11*b*, and the upper side 11*a* is located above a horizontal passing through the top 11*d*. The angle of tops 11*d* should preferably be made acute. The reflection mirror 3 forms a shadow when the light is not illuminated. Then, the acute top angle of the grooves will further increase the effect of preventing a false impression of illumination. Whether the light source should be positioned above or below the visor 10 may be selected in accordance with the vehicle design.

Figure 6:
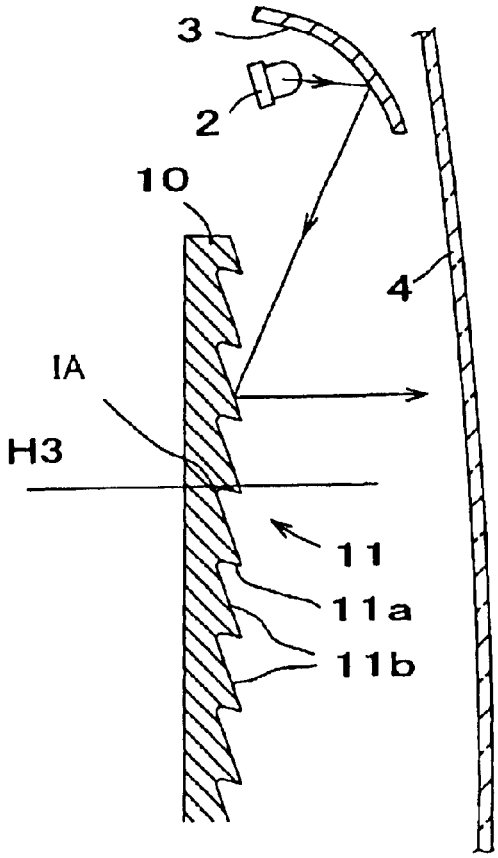
FIG. 6 is a cross sectional view of a vehicle lamp with a visor according to another preferred embodiment of the invention.

In the embodiment of the invention shown in FIG. 6, the upper side 11*a* and lower side 11*b* can extend downwardly from a horizontal plane H3 that contains intersection axis IA. The intersection axis can be formed by the intersection of an imaginary plane extending from and containing upper side 11*a* with an imaginary plane extending from and containing lower side 11*b*.

Figure 7:
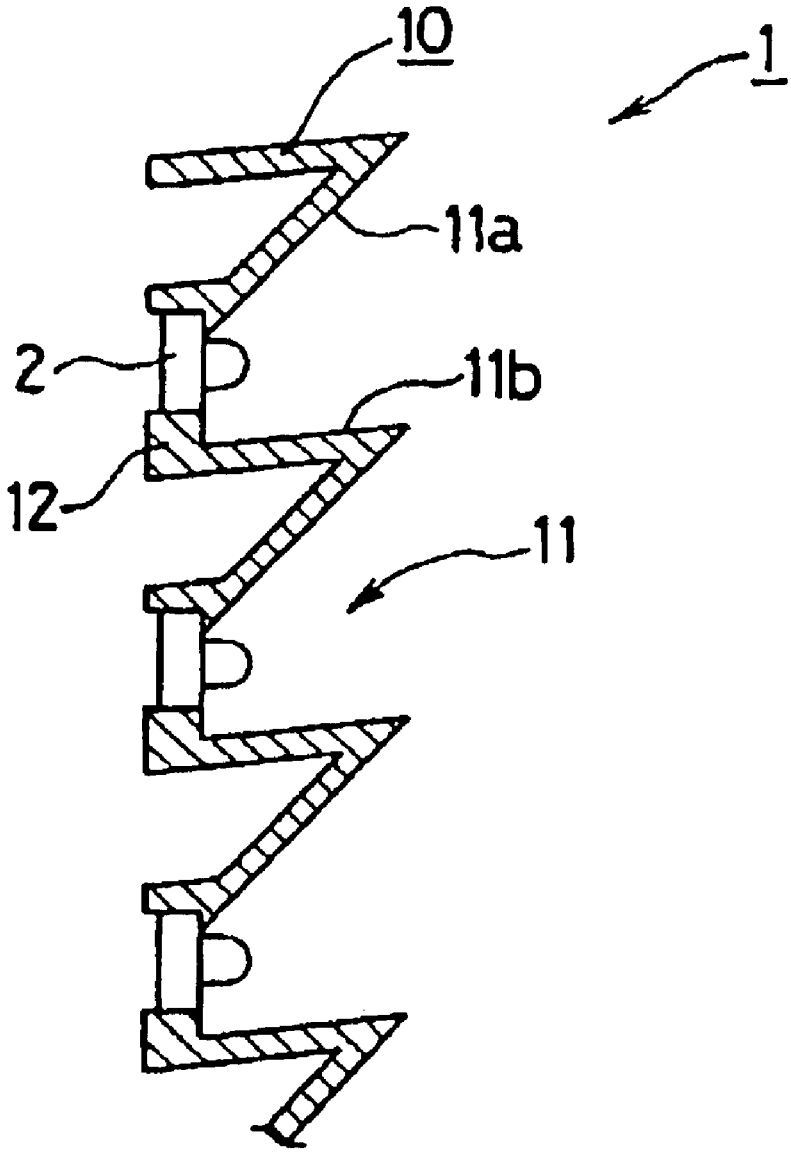
FIG. 7 is a cross sectional view of a vehicle lamp with a visor according to another preferred embodiment of the invention.

FIG. 7 illustrates major parts of a vehicle lamp 1 according to another embodiment. This lamp 1 has a plurality of LED lamps as light sources 2, and desired light distribution characteristics are achieved mainly by directing light beams from these light sources 2. The LED lamps may be attached to light source mounting portions 12 having an appropriate shape to be mounted in the bottoms of the V-shaped grooves 11. The light source mounting portions 12 may include a reflection surface of suitable form such as a paraboloid of revolution. Incandescent light bulbs may also be used as the light sources 2.

The vehicle lamp 1 provided with such a visor 10, even with a clear outer lens 4, will hardly give a false impression as if it were emitting light when illuminated by sunlight or other light sources from the outside. It thus helps prevent drivers' errors and offers improved vehicle lamp performance.

The present invention can widely be applied to vehicle lamps, and especially for illuminating the back of the vehicle, such as taillights, stop lamps, turn signal lamps, back-up lamps and various other lamps, and can also be used for signal lights (traffic lights).

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A vehicle lamp capable of irradiating light toward a predetermined direction, comprising:

a light source; and a visor for preventing the lamp from falling into a state of false illumination due to incident light from an outside light source other than said light source, said visor provided at a position adjacent said light source, said visor having a plurality of grooves on a surface thereof, said grooves each extending approximately parallel to the horizontal direction and having a V-shaped cross section as viewed along a longitudinal axis, an angle made by two sides forming said V-shaped cross section being an acute angle.

2. The vehicle lamp according to claim 1, wherein said two sides forming the V-shaped cross section intersect at an intersecting axis located at a bottom of each of the grooves, said two sides forming the V-shaped cross section are oriented upwards relative to a horizontal plane that contains the intersecting axis located at the bottom of each of the grooves.

3. The vehicle lamp according to claim 2, wherein said light source is arranged in front of and below said visor, and wherein an upper one of said sides forming the V-shaped cross section of the grooves is inclined at an angle determined so that parallel light from said light source is reflected by said upper one of said sides toward an illuminating direction of the lamp, whereby reflection light from said upper one of said sides is used as a false light source.

4. The vehicle lamp according to claim 3, further including a reflection surface for reflecting light from said light source in front of and below said visor and for irradiating the light toward the upper one of said sides of said visor.

5. The vehicle lamp according to claim 4, wherein said visor is divided into a plurality of sections each formed by grooves, said two sides forming the V-shaped cross section of the grooves being oriented upwards from their intersecting points at a predetermined angle, said angle being differed from one section to the other.

6. The vehicle lamp according to claim 4, further comprising an outer lens.

7. The vehicle lamp according to claim 2, wherein the surface of the visor has undergone a shining treatment.

8. The vehicle lamp according to claim 7, wherein said visor is divided into a plurality of sections each formed by grooves, said two sides forming the V-shaped cross section of the grooves being oriented upwards from their intersecting points at a predetermined angle, said angle being differed from one section to the other.

9. The vehicle lamp according to claim 7, wherein said visor is divided into a plurality of sections each formed by grooves, said two sides forming the V-shaped cross section of the grooves being oriented downwards from their intersecting points at a predetermined angle, said angle being differed from one section to the other.

10. The vehicle lamp according to claim 2, wherein a light source mounting portion is provided at a meeting location between said two sides forming the V-shaped cross section for mounting said light source.

11. The vehicle lamp according to claim 3, wherein said visor is divided into a plurality of sections each formed by grooves, said two sides forming the V-shaped cross section of the grooves being oriented upwards from their intersecting points at a predetermined angle, said angle being differed from one section to the other.

12. The vehicle lamp according to claim 2, further comprising an outer lens.

13. The vehicle lamp according to claim 3, further comprising an outer lens.

14. The vehicle lamp according to claim 1, wherein the surface of the visor has undergone a shining treatment.

15. The vehicle lamp according to claim 14, wherein said visor is divided into a plurality of sections each formed by grooves, said two sides forming the V-shaped cross section of the grooves being oriented upwards from their intersecting points at a predetermined angle, said angle being different from one section to the other.

16. The vehicle lamp according to claim 15, further comprising an outer lens.

17. The vehicle lamp according to claim 14, wherein said visor is divided into a plurality of sections each formed by grooves, said two sides forming the V-shaped cross section of the grooves being oriented downwards from their intersecting points at a predetermined angle, said angle being different from one section to the other.

18. The vehicle lamp according to claim 17, further comprising an outer lens.

19. The vehicle lamp according to claim 14, wherein a light source mounting portion is provided substantially near an intersecting axis of the grooves for mounting said light source.

20. The vehicle lamp according to claim 14, further comprising an outer lens.

21. The vehicle lamp according to claim 1, wherein a light source mounting portion is provided substantially near an intersecting axis of the grooves for mounting said light source.

22. The vehicle lamp according to claim 21, further comprising an outer lens.

23. The vehicle lamp according to claim 1, wherein said light source is arranged in front of and above said visor, and wherein a lower one of said sides forming the V-shaped cross section of the grooves is inclined at an angle determined so that parallel light from said light source is reflected by said lower one of said sides toward an illuminating direction of the lamp, whereby reflection light from said lower one of said sides is used as a false light source.

24. The vehicle lamp according to claim 23, further including a reflection surface for reflecting light from said light source in front of and above said visor and for irradiating the light toward the lower one of said sides of said visor.

25. The vehicle lamp according to claim 24, wherein said visor is divided into a plurality of sections each formed by grooves, said two sides forming the V-shaped cross section of the grooves being oriented downwards from their intersecting points at a predetermined angle, said angle being differed from one section to the other.

26. The vehicle lamp according to claim 24, further comprising an outer lens.

27. The vehicle lamp according to claim 23, wherein said visor is divided into a plurality of sections each formed by grooves, said two sides forming the V-shaped cross section of the grooves being oriented downwards from their intersecting points at a predetermined angle, said angle being differed from one section to the other.

28. The vehicle lamp according to claim 23, further comprising an outer lens.

29. The vehicle lamp according to claim 1, further comprising an outer lens.

30. The vehicle lamp according to claim 1, wherein the light source includes one of an LED light source, a halogen light source, a discharge light source, an incandescent light source and a false light source formed by light emitted from a light located at a position away from the light source.

31. A traffic lamp capable of irradiating light toward a predetermined direction, comprising:

a light source; and a visor for preventing the lamp from falling into a state of false illumination due to incident light from an outside light source other than said light source, said visor provided at a position adjacent said light source, said visor having a plurality of grooves on a surface thereof, said grooves each extending approximately parallel to the horizontal direction and having a V-shaped cross section as viewed along a longitudinal axis, an angle made by two sides forming said V-shaped cross section being an acute angle.

* * * * *